US008797158B2

(12) United States Patent
Mutch et al.

(10) Patent No.: US 8,797,158 B2
(45) Date of Patent: Aug. 5, 2014

(54) EMERGENCY NOTIFICATION SYSTEM UTILIZING DIGITAL SIGNAGE AND REMOTE SURVEILLANCE MONITORING

(76) Inventors: Mark C. Mutch, Bay Village, OH (US); Lloyd W. Hemphill, Westlake, OH (US); Donald J. Keehan, Jr., Westlake, OH (US); Denio A. Leone, Rocky River, OH (US); Mark B. Thompson, Westlake, OH (US)

( * ) Notice: Subject to any disclaimer, the term of this patent is extended or adjusted under 35 U.S.C. 154(b) by 330 days.

(21) Appl. No.: 13/318,322

(22) PCT Filed: Apr. 29, 2010

(86) PCT No.: PCT/US2010/032930

§ 371 (c)(1),
(2), (4) Date: Oct. 31, 2011

(87) PCT Pub. No.: WO2010/127085

PCT Pub. Date: Nov. 4, 2010

(65) Prior Publication Data

US 2012/0050039 A1 Mar. 1, 2012

Related U.S. Application Data

(60) Provisional application No. 61/173,762, filed on Apr. 29, 2009.

(51) Int. Cl.
*G08B 21/00* (2006.01)

(52) U.S. Cl.
USPC ..... 340/540; 725/33

(58) Field of Classification Search
USPC ..... 340/540
See application file for complete search history.

(56) References Cited

U.S. PATENT DOCUMENTS

| | | | | |
|---|---|---|---|---|
| 7,460,020 | B2 | 12/2008 | Reyes et al. | |
| 8,228,176 | B2 * | 7/2012 | Lewis | 340/332 |
| 2002/0077896 | A1 * | 6/2002 | Liu et al. | 705/14 |
| 2006/0101690 | A1 * | 5/2006 | Terbet, Jr. | 40/607.09 |
| 2007/0188483 | A1 * | 8/2007 | Bonner | 345/204 |
| 2008/0034114 | A1 | 2/2008 | Ducey et al. | |
| 2008/0189721 | A1 | 8/2008 | Buchanan | |
| 2008/0191863 | A1 | 8/2008 | Boling et al. | |
| 2008/0307044 | A1 * | 12/2008 | Musson | 709/203 |
| 2009/0144157 | A1 * | 6/2009 | Saracino et al. | 705/14 |
| 2009/0273463 | A1 * | 11/2009 | Morwood et al. | 340/514 |
| 2010/0002845 | A1 | 1/2010 | Zerillo et al. | |
| 2010/0211972 | A1 * | 8/2010 | Howarter et al. | 725/33 |

FOREIGN PATENT DOCUMENTS

| | | | |
|---|---|---|---|
| JP | 2003-016559 | A | 1/2003 |
| JP | 2003-256962 | A | 9/2003 |
| JP | 2007-2200076 | A | 8/2007 |
| KR | 10-0783160 | B1 | 12/2007 |

* cited by examiner

*Primary Examiner* — Kerri McNally
(74) *Attorney, Agent, or Firm* — Howard M. Cohn; Daniel Cohn

(57) ABSTRACT

An emergency notification system is provided. The emergency notification system comprises an emergency notification server (206), a signage server (202), digital signage displays (208); and a data communications network (134), wherein the emergency notification server (206) is configured to communicate with the signage server (202) via the data communications network (134) and wherein the emergency notification server (206) is configured to indicate if the emergency notification system (100) is in a non-emergency state or in an emergency state, and wherein the signage server (202) serves different data to the plurality of digital signage displays (208) depending on if the state of the emergency notification system (100) is in a non-emergency state or in an emergency state.

19 Claims, 6 Drawing Sheets

EMERGENCY NOTIFICATION SYSTEM UTILIZING DIGITAL SIGNAGE AND REMOTE SURVEILLANCE MONITORING

CROSS-REFERENCE TO RELATED APPLICATIONS

This application claims the benefit of U.S. Provisional Patent Application No. 61/173,762 entitled "EMERGENCY NOTIFICATION SYSTEM UTILIZING DIGITAL SIGNAGE AND REMOTE SURVEILLANCE MONITORING" filed on Apr. 29, 2009, which is hereby expressly incorporated herein by reference.

BACKGROUND

Typical emergency notification systems rely on users subscribing to various services in order to receive emergency notifications in the form of e-mail or text messages to mobile devices. On college campuses, student enrollment in these services is relatively low as compared with the total student population. This is because students are often reluctant to give out the personal information required to subscribe to these services. In the case of a shopping mall or other large retail center, there is no opportunity for patrons to sign up for a service, yet there is still a need to distribute information in the event of an emergency. Cellular networks can become congested during emergencies. This adversely impacts the reliability of text messaging. Therefore, it is desirable to have an improved emergency notification system to address the aforementioned shortcomings.

SUMMARY OF THE INVENTION

Embodiments of the present invention provide an Emergency Notification System (ENS) that is well suited to a large complex, such as a college campus, corporate campus, medical center, shopping mall, convention center, airport, train station, and the like. Embodiments of the ENS may comprise remote video surveillance technology. A plurality of digital signage displays (DSDs) are positioned at strategic locations to appropriately disseminate needed information. The ENS interfaces with a variety of other notification systems to aggregate emergency information, and convey it to the DSDs. One or more servers are used to aggregate content. A plurality of clients are used to control and configure the ENS. Embodiments of the present invention provide redundancy in the event of equipment failure, such as a server failure or network outage.

According to the present invention, an emergency notification system, comprises: an emergency notification server; a signage server; a plurality of digital signage displays; and a data communications network. The emergency notification server is configured to communicate with the signage server via the data communications network and wherein the emergency notification server is configured to indicate if the emergency notification system is in a non-emergency state or in an emergency state. The signage server serves different data to the plurality of digital signage displays depending on if the state of the emergency notification system is in a non-emergency state or in an emergency state.

Further according to the present invention, an emergency notification system, comprises: an emergency notification server; a signage server; a plurality of digital signage displays; and a data communications network. The emergency notification server is configured to communicate with the signage server via the data communications network. The emergency notification server is configured to indicate if the emergency notification system is in a non-emergency state or in an emergency state. The signage server serves different data to the plurality of digital signage displays depending on if the state of the emergency notification system is in a non-emergency state or in an emergency state. Each of the plurality of digital signage displays is configured to display a tiny uniform resource locator corresponding to a client instantiation. The client instantiation comprises a plurality of sequence controls.

Still further according to the present invention, a method of providing emergency notifications at a facility, comprises the following steps. Emergency information is received by an emergency notification server. At least one message is sent from the emergency notification server to a signage server. The message is indicative of an emergency state. The emergency information is sent from the emergency notification server to a signage server. The emergency information is sent from the signage server to a plurality of digital signage displays. At least one message is sent from the emergency notification server to a signage server, wherein the message is indicative of a non-emergency state upon termination of an emergency event.

These advantages, and others, will become apparent from the drawings and detailed description that follow.

BRIEF DESCRIPTION OF THE DRAWINGS

The structure, operation, and advantages of the present invention will become further apparent upon consideration of the following description taken in conjunction with the accompanying figures (FIGs.). The figures are intended to be illustrative, not limiting. In the drawings accompanying the description that follows, often both reference numerals and legends (labels, text descriptions) may be used to identify elements. If legends are provided, they are intended merely as an aid to the reader, and should not in any way be interpreted as limiting.

DETAILED DESCRIPTION

Figure 1:
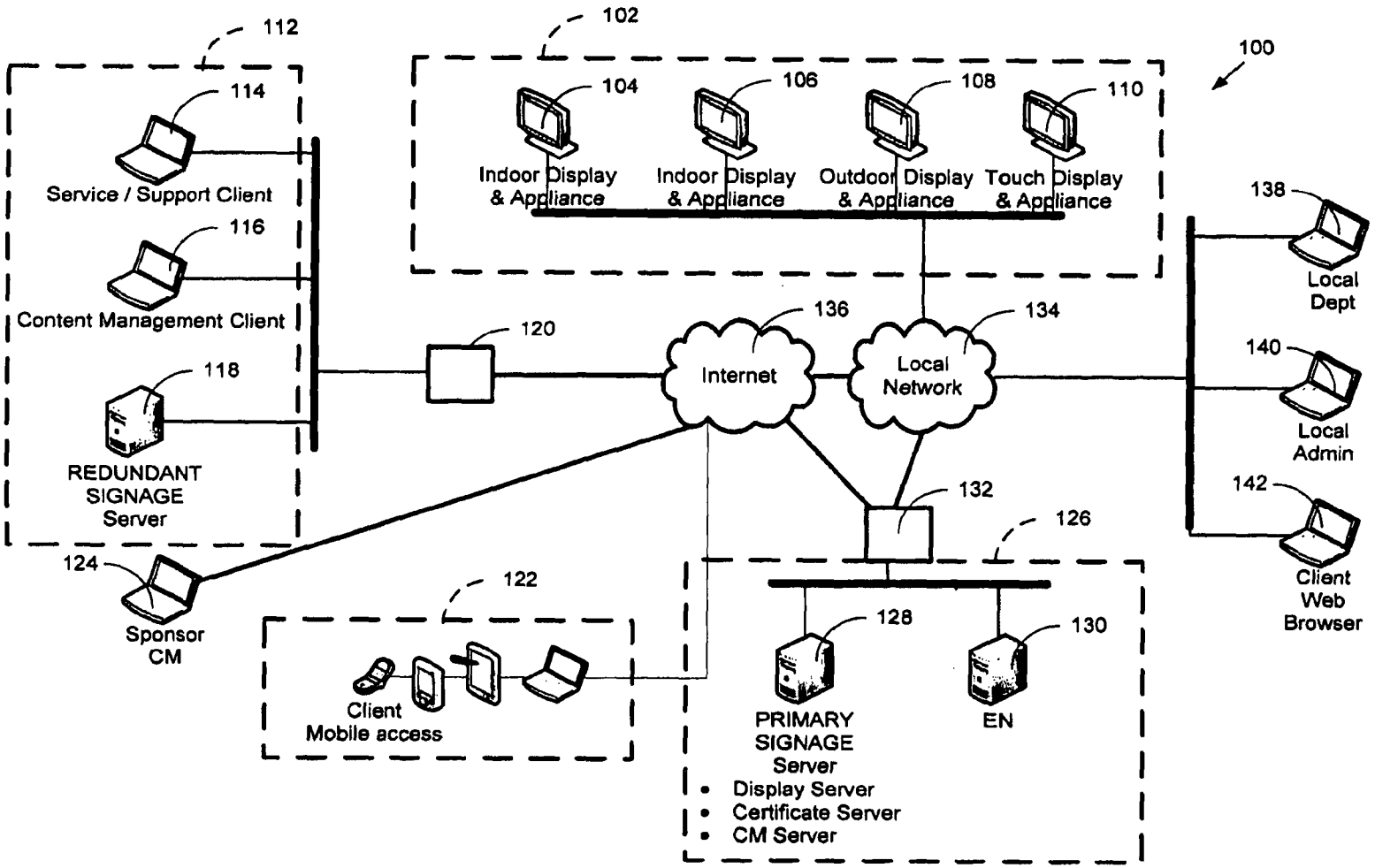
FIG. 1 is a system diagram of an embodiment of an ENS.

FIG. 1 shows an embodiment of an ENS 100 configured to operate at a university campus. Note that while a university campus is used in the following example, embodiments of the present invention are suitable for use in a wide variety of applications, including, but not limited to, hospitals, shopping malls, stadiums, military bases, and other large facilities. The ENS comprises display system 102, which is comprised of a plurality of digital signage displays (DSDs). In this embodiment, display system 102 is comprised of four DSDs, 104, 106, 108, and 110. DSD 104 and DSD 106 are indoor devices. In other embodiments, other combinations of indoor and outdoor DSDs are possible. Some embodiments may comprise only outdoor DSDs, or only indoor DSDs. DSD 108 is an outdoor device, which is weatherized and theft protected to accommodate outdoor use. DSD 110 is a touch screen device that provides for user interaction with the device, such as, for example, allowing for following a hyperlink presented by DSD 110. Display system 102 is connected to local (a.k.a. "university") network 134. Also connected to local network 134 is local (a.k.a. "university") firewall 132. Behind firewall 132 are primary signage server 128, and Emergency Notification (EN) server 130 (also known as an "emergency campus notification" (ECN) server). The EN server 130 aggregates warning information from a variety of sources, which may include, but are not limited to, weather information, traffic information, as well as information from campus security, or local law enforcement agencies. The EN server 130 provides emergency notifications to the primary signage server 128. The EN server 130 and primary signage server 128 are also connected to the Internet 136.

The primary signage server communicates display data to the DSDs within display system 102. ENS 100 further comprises a management system 112 which comprises service/support client 114, content management client 116, and redundant signage server 118. In the event of a failure of primary signage server 128, redundant signage server 118 is switched to active mode to allow information to disseminate to the DSDs while the primary signage server 128 is offline. The redundant signage server 118 can be virtualized (one server to backup more than one campus) and is updated periodically by the primary signage server 128 with new content. The devices within management system 112 are behind management firewall 120. The service/support client preferably provides a web-based user interface to allow for monitoring the health of the signage servers 128 and 118, and the EN server 130.

The content management (CM) client 116 preferably provides a web-based user interface to allow a content author to edit and add content that is displayed on the DSDs within display system 102. The sponsor CM client 124 allows a sponsor to edit the content of their advertisements. This provides independent control for the advertising information, separate from the other campus information.

One or more local department clients 138 allow various departments within the university to post information to display system 102. For example, the athletic department may post an upcoming football schedule or scores from recent sporting events. Similarly, local administration client 140 allows for an administrative user to update information, such as school closing information, exam schedules, and the like. Note that while this example is referring to a university, embodiments of the present invention can be configured for other venues, such as hospitals, military basis, corporate campuses, and the like. A client computer 142 with a web browser may also access the content that is being output to the DSDs within display system 102. In this way, a student in a dorm room can access pertinent campus information even if they are not near one of the DSDs. For users that wish to subscribe to notifications on their mobile devices 122, the ENS dispatches text messages and/or emails to the subscribers, as per subscriber preference.

Figure 2:
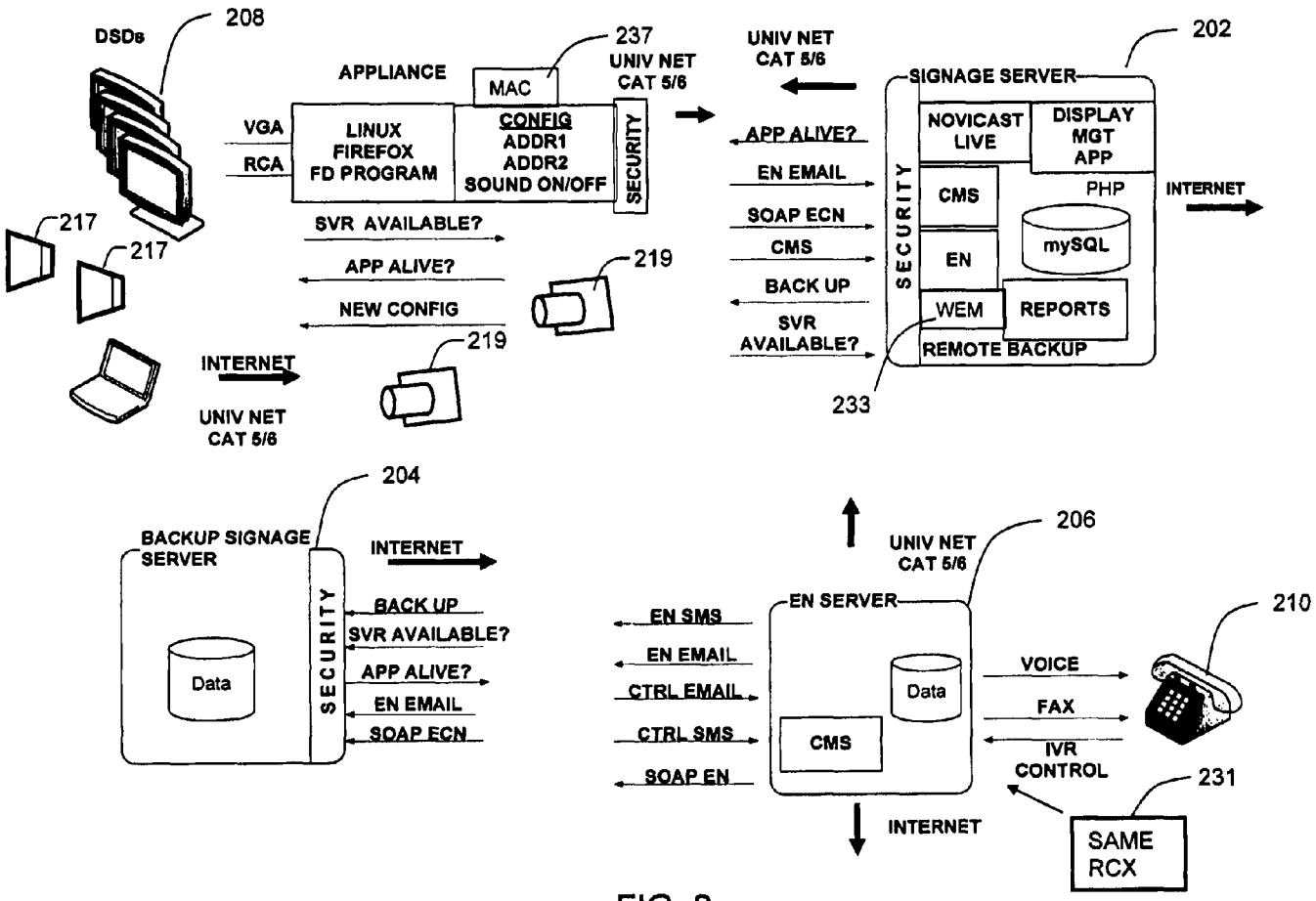
FIG. 2 is a block diagram showing internal details of system components.

FIG. 2 is a block diagram showing internal details of system components. As can now be seen, within signage server 202 is a variety of components, such as a CMS module to receive CM instructions regarding updating content, and an EN module to receive emergency alert information. Web echo module (WEM) 233 is configured to access various public websites to aggregate information that is displayed, particularly during non-emergency use. Examples of such information may originate from popular news, weather, and sports web sites.

A display management application controls the display of the various DSDs. The EN server 206 is configured to interact with a telephone 210 using Interactive Voice Response (IVR), which is telephone technology that uses voice commands or digit presses to control computer functions. This feature allows quick access to the ENS by on-site security personnel. In case of an emergency, the security personnel can interact with the EN server via phone to post an alert message that will be displayed on the DSDs 208. In one embodiment, the EN sever 206 integrates with a SAME (specific area message encoding) capable radio receiver 231, to enable reception of weather-related alerts directly from the national weather service. In one embodiment, the EN server 206 and signage servers (202, 204) communicate via Simple Object Access Protocol (SOAP). A variety of SOAP messages may be used, including, but not limited to, an "emergency status activated" (ESA) message, and an "emergency status deactivated" ESD message. These messages instruct the signage server if the EN is in an emergency state or a non-emergency state. In a non-emergency state, information and advertisements may be displayed on the DSDs. In an emergency state, the signage server 202 serves the emergency information to the appropriate DSDs. Each DSD is network capable, and in one embodiment, includes an Ethernet MAC address 237. The MAC address 237 may be used as a unique identifier to allow signage data to be targeted to a specific DSD. Alternatively, a multicast protocol may be used, where multiple DSDs join a particular group to allow group addressability.

The DSD 208 utilizes TLS (Transport Layer Security) and has certificates installed. The browser running on the DSD accesses content through https, ensuring that content is encrypted during transport. Furthermore, a trust server may be used to facilitate a means for the DSD to verify the Content Server being accessed based on the certificate authentication of the Trust Server. Likewise, the Content Server will verify the DSD to allow access to the content. This technique prevents rogue displays from accessing the content.

Each DSD 208 has an on board computer that executes an operating system and application software to control the DSD. In one embodiment, the DSD computer runs Linux with Firefox to render HTML pages, Flash, and other web-based display technologies. In one embodiment, the DSD utilizes Remote Shell Access (RSH) to authenticate remote users. Remote users must install valid certificates in order to access the DSD. These certificates have an expiry time, to add an increased measure of security. In addition, physical security measures are also present. For example, there is no external access to any computer ports or power buttons. A secure bootloader prevents unauthenticated applications, boot devices, or hardware from being used on DSDs.

The signage server 202, backup signage server 204, and DSDs 208 periodically emit heartbeat signals, and listen for heartbeat signals from each other. This allows for failover in the event of a problem. In one embodiment, the heartbeat signals are periodically sent via SOAP. For example, if signage server 202 fails to send a heartbeat signal, the DSDs can then retrieve content from the backup signage server 204. The address of the primary signage server 202 and the address of the backup signage server 204 are stored in a configuration file on the DSD. If the signage server fails, the DSDs 208 can quickly determine the address of the backup signage server to minimize any disruption in the display on the DSD. In one embodiment, DSDs 208 also provide audio via attached speakers. The audio information is preferably streamed to the DSD using a voice-over-IP (VoIP) protocol. In this way, audible alerts may also be disseminated via the DSD. One or more audio alert devices (AAD) 217 may also be utilized in the emergency notification system. Audio alert devices 217 are preferably configured to receive a VoIP data stream, and output the associated audio via an associated amplifier and speaker. This facilitates alert capability where a visual display is not feasible, and also allows visually impaired persons to receive emergency information.

Other embodiments may also comprise one or more video surveillance cameras 219. Cameras 219 are preferably mounted in proximity to the DSDs 208. Cameras 219 may be configured to stream live video via internet protocol, such that they may be monitored from a central location, such as the security office of a facility. This capability extends the ability of emergency management personnel to manage various emergency situations, as it allows the emergency personnel to assess the crowd levels, and movement of crowds, at various locations.

Each DSD and each AAD has a unique identifier within the ENS that may be used for individual addressability. As the DSD and AAD are networked devices, in one embodiment, the MAC address of each device is used as a unique identifier (UID). This allows the signage server (302 of FIG. 3) to direct particular data to a particular DSD or AAD. In another embodiment, multicast groups are formed to facilitate group-based notification. For example, consider a facility with two buildings, a "North" building, and a "South" building. In the case of a water main break in the North building, the signage server 302 sends evacuation instructions to a North multicast group, which addresses all DSDs and AADs in the North building, while not impacting the information presented by DSDs and AADs in the South building.

Figure 3:
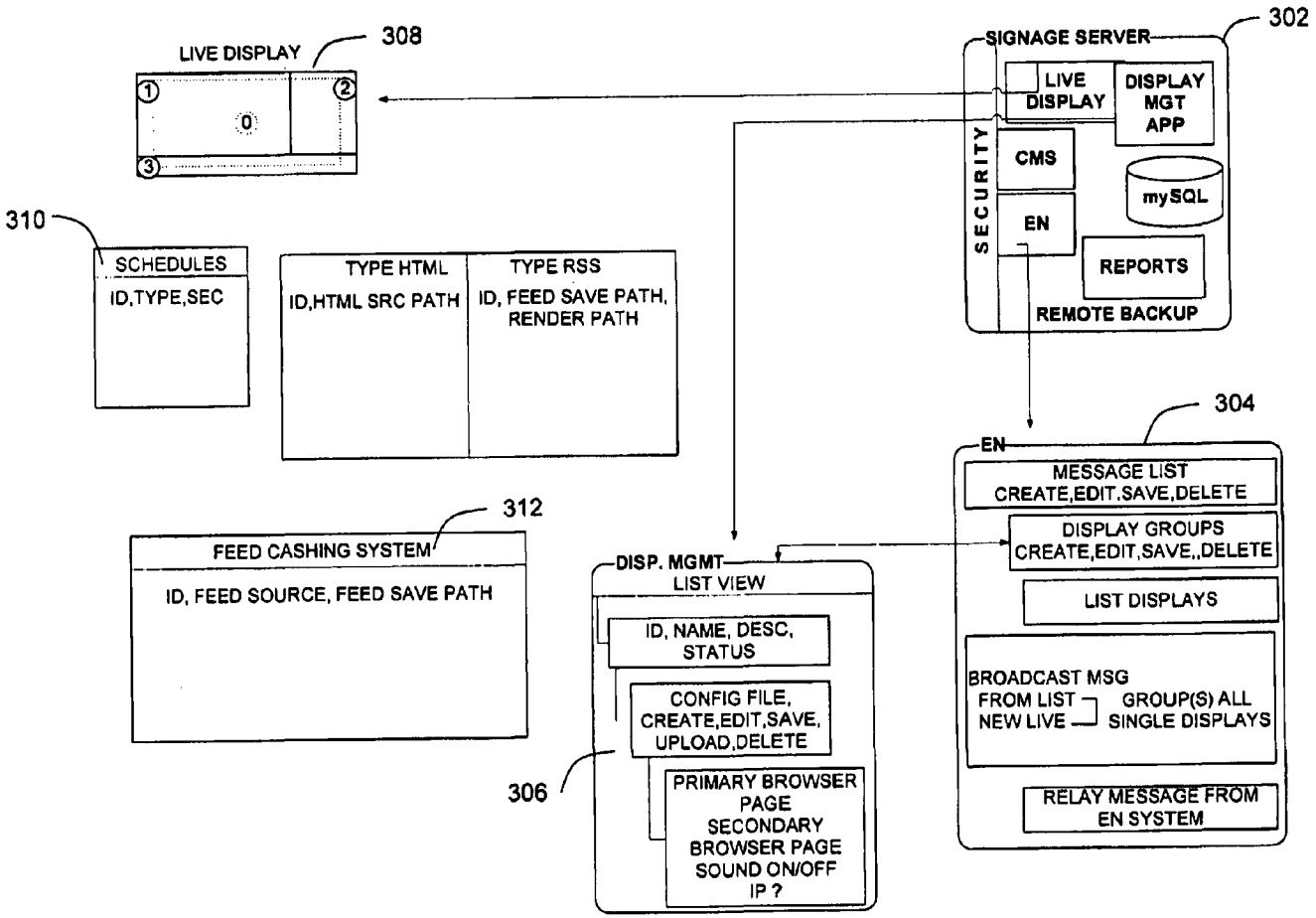
FIG. 3 is a block diagram showing configuration options of system components.

FIG. 3 is a block diagram showing configuration options of system components. Signage server 302 has an EN module implemented therein, which provides a list of configuration options 304. These configuration options may include, but are not limited to, creating, editing, and deleting of messages, managing of display groups, and establishing different message types. Messages may be broadcast to all DSDs on campus, or may be multicast to a particular group of DSDs, or singlecast to a specific DSD. Each DSD has a unique ID established within it to provide individual addressability.

Signage server 302 has a display management application implemented therein, which provides a list of configuration options 306. These configuration options may include, but are not limited to, establishing a primary browser page, a secondary browser page, configuring the sound options, and establishing an IP address for each of the DSDs, if necessary.

Each DSD runs a live display application 308 that renders the content on the screen of each DSD. The live display application comprises a feed caching system 312 which aggregates content from a variety of RSS feeds. A schedule module 310 keeps track of various tasks that need to be performed, such as scheduling the display of various RSS feeds. In one embodiment, javascript, PHP and Ajax are used to implement the schedule function. The PHP script receives schedule and template information, renders the cached xml images and templates, and returns the rendered result to be displayed on the DSD.

Figure 4:
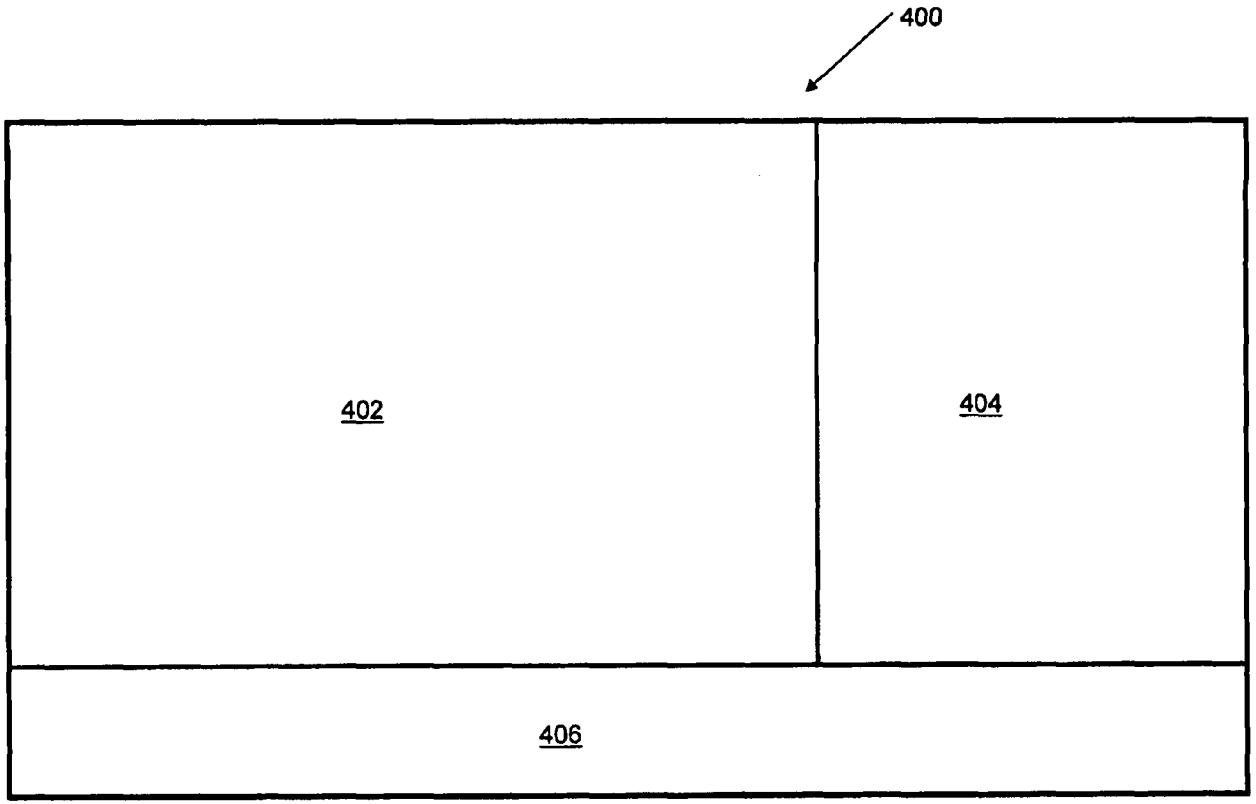
FIG. 4 is a view of an embodiment of a digital signage device.

FIG. 4 is a view of an embodiment of a digital signage device (DSD) 400. In this embodiment, the display is divided into three display regions. Region 402 is the informative region, which displays general information, such as sports, news, or weather, for example. In one embodiment, region 404 is the sponsor region that displays advertisements. These advertisements can provide a revenue source for the university. Region 406 is the status region, where emergency messages are displayed. Note that while in an emergency state, one or more of the regions (402, 404, and 406) may be used to convey emergency information. While in a non-emergency state, DSD 400 may display advertisements in one or more of the regions (402, 404, and 406).

Figure 5:
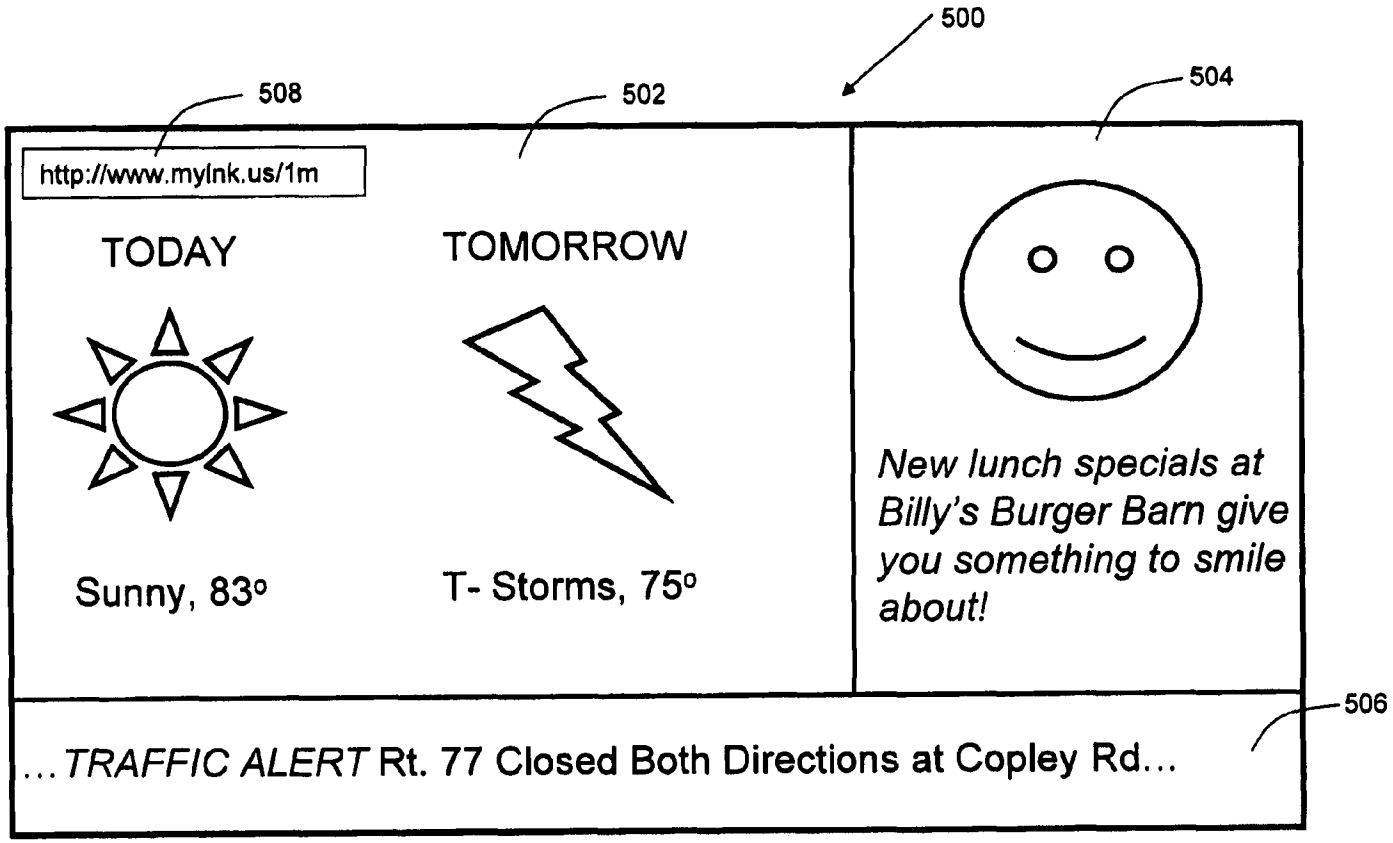
FIG. 5 is a view of an embodiment of a digital signage device showing an example of presented information.

FIG. 5 is a view of an embodiment of a digital signage device 500 showing an example of presented information. In this example, informative region 502 is displaying weather information. Sponsor region 504 is displaying an advertisement for a restaurant. Status region 506 is displaying traffic information regarding a road closure. In the embodiment shown in FIG. 5, region 506 is displaying information as a text crawl (text scrolling across the screen). In another embodiment, region 506 may be display a static message, or may also be an advertisement. Access link 508 displays a hyperlink that a user may use to access a client instantiation of a digital signage device. The location of access link 508 within the display of the digital signage device 500 can vary, and the embodiment shown in FIG. 5 is merely an example of a possible placement for access link 508. In one embodiment, the link displayed to the user may be a tiny URL (uniform resource locator), converted from the actual link, to facilitate easy entry into a web browser by a user. The tiny URL represents the same information as the actual link, but is of reduced characters (e.g. via a hash table or other suitable information mapping mechanism) to facilitate quick entry into a browser. This is especially convenient for mobile devices, such as smart phones.

Figure 6:
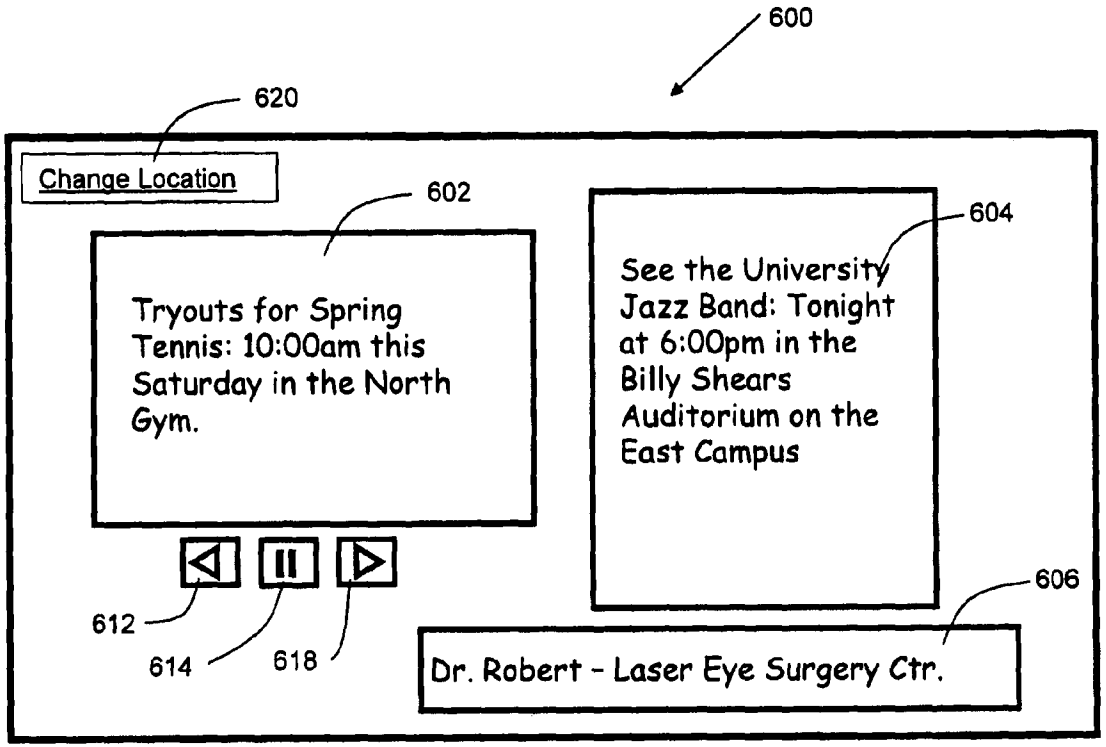
FIG. 6 is a view of an embodiment of a client instantiation of a digital signage device showing an example of presented information.

FIG. 6 is a view of an embodiment of a client instantiation 600 of a digital signage device (DSD) showing an example of presented information. In one embodiment, a user is presented with this information upon entering the access link such as that shown in FIG. 5 (reference number 508). Three asynchronously updating regions, (panes) 602, 604, and 606 display information. The information may comprise emergency information, pertinent local information, information aggregated from various websites, or advertisements. A digital signage device (DSD) (e.g. 500 of FIG. 5) updates at a periodic interval. In one embodiment, the update rate is every 60 seconds.

The client instantiation 600 provides the ability of a user to change the client instantiation 600 to show a previous version of the DSD, or to index ahead to a future version of the DSD. Sequence control 612 allows a user to control the display of content on the client instantiation. In particular, sequence control 612 selects content for display on the client instantiation 600 that was previously displayed on a digital signage display (208 of FIG. 2). Sequence control 614 allows a user to pause content on the client instantiation 600. Sequence control 618 allows a user to access content that is scheduled to be displayed on the DSD in the future and display that content on the client instantiation 600. In this way, a user can see all pertinent signage information from previous display cycles or future display cycles.

The Change Location user interface control 620 allows a user to select a specific DSD sign or region to instantiate. For example, in a facility having an East, West, and North building, the DSDs may display different information in each building. When the "Change Location" control 620 is invoked, the user is provided with a list (not shown) of locations which may be selected. In this way, a user can access a specific DSD or location, to receive targeted information for that particular location. The location of user interface control 620 within the display of the client instantiation 600 can vary, and the embodiment shown in FIG. 6 is merely an example of a possible placement for user interface control 620.

By implementing an ENS in accordance with the present invention, important information is available to everyone on campus without the need to specifically subscribe to an alert service. Furthermore, many types of alerts are aggregated by the ENS, such as weather, traffic, fire, lockdown situations, to name a few. The DSDs therefore provide a convenient means for informing users about critical situations, and improve the safety of students, faculty, office workers, and other patrons of a university or other institution.

Although the invention has been shown and described with respect to a certain preferred embodiment or embodiments, certain equivalent alterations and modifications will occur to others skilled in the art upon the reading and understanding of this specification and the annexed drawings. In particular regard to the various functions performed by the above described components (assemblies, devices, circuits, etc.) the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application.

What is claimed is:

1. An emergency notification system, comprising:

an emergency notification server;

a signage server;

a plurality of digital signage displays;

a data communications network, wherein the emergency notification server is configured to communicate with the signage server via the data communications network and wherein the emergency notification server is configured to indicate if the emergency notification system is in a non-emergency state or in an emergency state, and wherein the signage server serves different data to the plurality of digital signage displays depending on if the state of the emergency notification system is in a non-emergency state or in an emergency state; and wherein each of the plurality of digital signage displays is configured to display a uniform resource locator corresponding to a client instantiation; and wherein the emergency notification server is configured to interact with a telephone using Interactive Voice Response and/or with a specific area message encoding receiver.

2. The emergency notification system of claim 1, wherein the emergency notification server is configured to communicate with the signage server via HTTP protocols.

3. The emergency notification system of claim 1, wherein the signage server is configured to periodically send heartbeat signals, and wherein each digital signage display is configured to receive said heartbeat signals, and wherein each digital signage display is configured to retrieve signage data from the backup signage server if a heartbeat signal is not detected within a predetermined time interval.

4. The emergency notification system of claim 1, further comprising at least one audio alert device and at least one audio alert device is configured to receive audio information via VOIP.

5. The emergency notification system of claim 1, wherein each of the plurality of digital signage displays is configured to display information in a plurality of display regions.

6. The emergency notification system of claim 5, wherein at least one of the display regions is configured to display a text crawl and wherein at least one of the display regions is configured to display an advertisement.

7. The emergency notification system of claim 1, wherein the uniform resource locator is a tiny URL.

8. The emergency notification system of claim 1, wherein the client instantiation further comprises a change location user interface control, wherein the change location user interface control is configured to provide an option to select a location corresponding to a particular digital signage display.

9. The emergency notification system of claim 1, wherein the client instantiation further comprises a sequence control configured to allow display of content on the client instantiation, wherein the content is content that was previously displayed on a digital signage display.

10. The emergency notification system of claim 1 wherein the client instantiation further comprises a sequence control configured to allow display of content on the client instantiation, wherein the content is scheduled for future display on a digital signage display.

11. The emergency notification system of claim 1, wherein the client instantiation further comprises a sequence control configured to allow pausing of the content that is displayed in the client instantiation.

12. The emergency notification system of claim 1, wherein the signage server further comprises a web echo module, wherein the web echo module is configured to retrieve information from a plurality of public web sites.

13. The emergency notification system of claim 1, wherein the signage server is configured to send data to each of the plurality of digital signage displays via singlecast messages.

14. The emergency notification system of claim 1, wherein the signage server is configured to send data to each of the plurality of digital signage displays via multicast messages.

15. The emergency notification system of claim 13, wherein the singlecast messages of each digital signage display is based on a MAC address corresponding to each digital signage display.

16. An emergency notification system, comprising:

an emergency notification server;

a signage server;

a plurality of digital signage displays; and a data communications network, wherein the emergency notification server is configured to communicate with the signage server via the data communications network and wherein the emergency notification server is configured to indicate if the emergency notification system is in a non-emergency state or in an emergency state, and wherein the signage server serves different data to the plurality of digital signage displays depending on if the state of the emergency notification system is in a non-emergency state or in an emergency state; and wherein each of the plurality of digital signage displays is configured to display a tiny uniform resource locator corresponding to a client instantiation, and wherein the client instantiation comprises a plurality of sequence controls.

17. The emergency notification system of claim 16, wherein the client instantiation further comprises a sequence control configured to allow display of content on the client instantiation, wherein the content is content that was previously displayed on a digital signage display.

18. The emergency notification system of claim 17, wherein the signage server, is configured to periodically emit heartbeat signals via HTTP protocols.

19. The emergency notification system of claim 16, further comprising one or more video surveillance cameras.

* * * * *